US007434916B2

(12) United States Patent
Mukai et al.

(10) Patent No.: US 7,434,916 B2
(45) Date of Patent: Oct. 14, 2008

(54) LIQUID EJECTION HEAD

(75) Inventors: Kayo Mukai, Tokyo (JP); Masahiro Hamano, Beppu (JP)

(73) Assignee: Canon Finetech Inc., Ibaraki (JP)

( * ) Notice: Subject to any disclaimer, the term of this patent is extended or adjusted under 35 U.S.C. 154(b) by 51 days.

(21) Appl. No.: 11/678,878

(22) Filed: Feb. 26, 2007

(65) Prior Publication Data

US 2007/0206063 A1 Sep. 6, 2007

(30) Foreign Application Priority Data

Mar. 3, 2006 (JP) ..... 2006-058413

(51) Int. Cl.
*B41J 2/01* (2006.01)

(52) U.S. Cl. ..... 347/61; 347/67

(58) Field of Classification Search ..... 347/56, 347/61, 63, 65, 67
See application file for complete search history.

(56) References Cited

U.S. PATENT DOCUMENTS 5,278,585 A * 1/1994 Karz et al. ..... 347/65
2006/0164477 A1 7/2006 Fujii et al.
2007/0206063 A1 9/2007 Mukai et al.
2007/0206064 A1 * 9/2007 Mukai et al. ..... 347/61

FOREIGN PATENT DOCUMENTS

JP 63-197652 8/1988
JP 10-16243 1/1998

OTHER PUBLICATIONS

Computer-generated translation of JP 10-016243 cited in the IDS filed on Feb. 26, 2007.*

* cited by examiner

*Primary Examiner*—Huan H Tran
(74) *Attorney, Agent, or Firm*—Fitzpatrick, Cella, Harper & Scinto

(57) ABSTRACT

Disclosed is a liquid ejection head capable of performing a stable ejection operation at high speed even when thermal expansion of a valve supporting member occurs during liquid ejection. This is because the liquid ejection head allows the thermal expansion to influence supported valves only to a small extent, and a highly accurate and stable adhesion state to be obtained. To this end, first holes, second holes and slits are provided in the valve supporting member.

9 Claims, 10 Drawing Sheets

FIG.6A
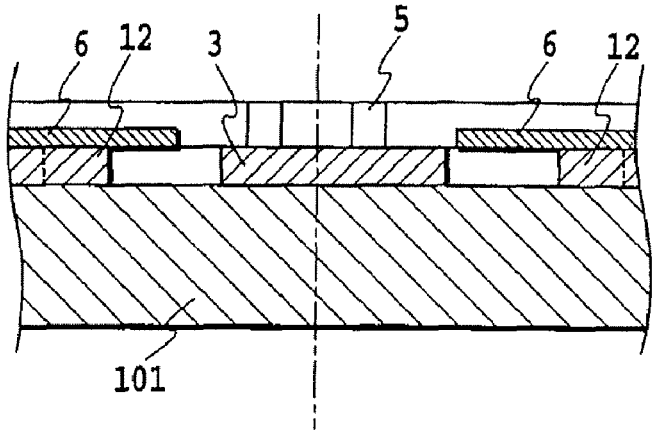
FIG.6B
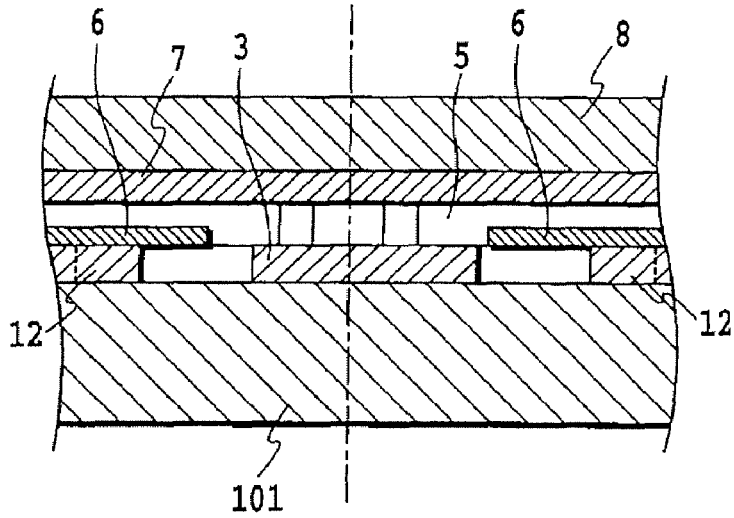
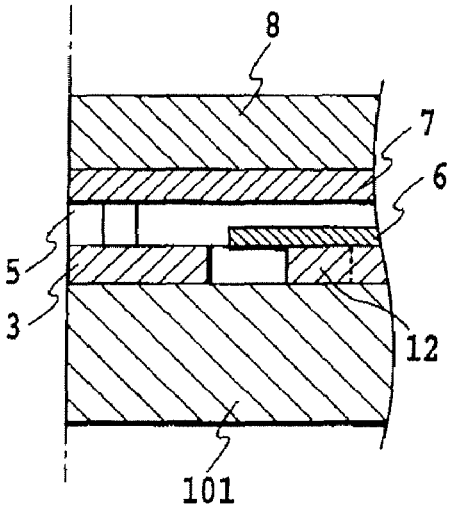
FIG.6C
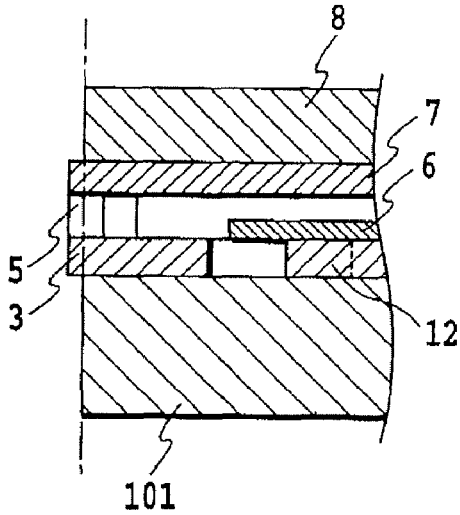
FIG.6D

LIQUID EJECTION HEAD

BACKGROUND OF THE INVENTION

1. Field of the Invention

The present invention relates to a liquid ejection head. In particular, the present invention relates to a liquid ejection head using a method in which a state of liquid is changed along with a rapid volume change of the liquid (generation of bubbles) by applying heat energy to the liquid, and in which an acting force caused by this change of the state allows the liquid to be ejected from an ejection port, 2. Description of the Related Art In general, in an inkjet printing head of this type, provided is a liquid path extending towards an ejection opening from an upstream side in an ink supplying direction, and the liquid path is provided with a heater (such as an electrothermal transducer) which generates thermal energy applied to ink. Then, a state of ink on the heater facing the liquid path is changed (film boiling generates a bubble) when the heater is driven, and this change causes a pressure with which ink existing on an ejection opening side from the heater to be ejected. This bubble phenomenon itself, however, does not have any directional characteristics, so that the pressure caused by the bubble affects, in the ink channel, not only on the direction in which the ink is to be ejected, but also on the upstream side in the ink supplying direction. This phenomenon generates energy loss, thereby reduces the amount of the energy which is to effectively contribute to ink ejection, decreases an ink ejection speed, and thus deteriorates printing quality. In addition to the above problems, the pressure towards the upstream side in the ink supply direction causes a delay in an operation to replenish (refill) ink of the amount equivalent to that lost due to the ejection. Thus, the pressure is also a factor to prevent printing speed from being speeded up.

In recent years, a demand for printing an image with a stable printing quality at high speed has been increasing. This demand is particularly apparent for printing apparatuses for industrial applications. Thus, in some cases, employed is the following configuration which aims to increase effective use of energy, and to facilitate a smoother refill operation. In this configuration, a movable member is provided in the liquid path, and the movable member operates as a valve in response to the generation of bubble. Thus, the movable member controls the growth of bubble so that the bubble would not go to the upstream side in the ink supply direction.

In Japanese Patent Laid-Open No. 63-197652 (1988) (referred to as Japanese Patent Laid-Open No. 63-197652 A, below), disclosed is a configuration in which a valve is integrally formed as a single body by utilizing part of a substrate having a heater formed thereon. Japanese Patent Laid-Open No. 63-197652 A also cites another configuration as a conventional example. In this configuration, a printing head includes a structure in which a valve or a member (a valve retaining member) having the valve formed thereon is separated from a member (substrate) having a heater formed thereon, and the valve or the valve retaining member is attached to the substrate in a process later performed. Then, in terms of this configuration, the following problems are described: since it is difficult to form a fine valve, it is not easy to form a fine liquid path; and since the valve is attached to the liquid path by use of an adhesion method or the like, not only does the number of assembly processes increase, thereby leading to an increase in manufacturing costs, but also a reduction in reliability, and instability of ejection performance may be caused depending on the attachment accuracy. Thus, Japanese Patent Laid-Open No. 63-197652 A discloses the structure in which the substrate and the valve are previously integrated into a single body, and a method of manufacturing the same in order to solve these problems.

In contrast to this, in FIG. 11 of Japanese Patent Application Laid-Open No. 10-16243 (1998) (referred to as Japanese Patent Laid-Open No. 10-16243 A, below), disclosed is a method of manufacturing a printing head having a two-body structure formed of a substrate and a valve retaining member. Specifically, Japanese Patent Laid-Open No. 10-16243 A discloses the method in which a supporting member at least having its surface formed of metal is disposed on a substrate including a resistor element (a heater), and in which a metallic separation wall (a valve retaining member) having a movable member is fixed to the substrate by the supporting member. In the embodiment of the invention, a method of bonding and fixing, that is, attaching, the substrate and the separation wall to each other as follows. In this method, supporting members each formed of Au or the like of a stud bump type are respectively embedded into two substantially rear portions of the substrate; a separation wall formed of Ni or the like is positioned and mounted on the supporting members in the two portions; and a metal alloy layer between the supporting member and the separation wall is formed by performing a heat treatment or the like on the supporting member from above the separation wall. In this way, the substrate and the separation wall are bonded and fixed to each other. Furthermore, Japanese Patent Laid-Open No. 10-16243 A describes the following effect of this method. To be more precise, although the hardening and shrinkage of an adhesive agent adversely affects the attachment accuracy in a case where the adhesive agent is used, this method makes it possible to prevent this disadvantage from occurring.

Both Japanese Patent Laid-Open No. 63-197652 A, and Japanese Patent Laid-Open No. 10-16243 A intend to achieve an efficient use of energy for ink ejection, and a smoother refill operation, but employ the different basic configurations of the printing heads for achieving these purposes. Specifically, while the printing head disclosed in Japanese Patent Laid-Open No. 63-197652 A employs the structure in which the substrate and the valve retaining member are integrally formed in advance (hereinafter, termed as a single-body structure), the printing head disclosed in Japanese Patent Laid-Open No. 10-16243 A employs the structure in which the substrate and the valve retaining member each being formed as a separate member are adhered to each other (hereinafter, termed as a two-body structure).

As a result of a dedicated examination made by the inventors of the present invention on these structures, the inventors have obtained the following findings.

Specifically, first, in Japanese Patent Laid-Open No. 63-197652 A, in a process of manufacturing the member of the aforementioned single body structure, a layer made of a predetermined material (polysilicon in Japanese Patent Laid-Open No. 63-197652 A) is formed on a substrate, and then a portion which is to become a valve is superposed on the layer. Thereafter, the layer existing on a liquid path portion below the valve is etched. Thus, since the etching needs to be carried out in an area below the valve from the periphery of the valve, it is necessary to have some space in the periphery portion of the valve except a portion of the valve to be supported in a cantilevered manner, in order to allow the etching process to be carried out. Specifically, dimensions or a shape of the valve is limited when the etching process is taken into consideration. For this reason, desired dimensions of the valve, that is, a project area of the valve to the heater becomes small. Thus, there is a concern that the effective use of ejection energy, and a smoother refill operation, which are the desired objects, may not be achieved to a sufficient extent. This concern may particularly become a problem in a case where used is a printing head or a printing apparatus for industrial applications of which a stable ejection operation at high speed is strictly required.

Accordingly, it is strongly preferred that a valve having dimensions or a shape which is suitable for the desired objects be formed. Thus, it is advantageous to employ the two-body structure from a viewpoint of design and manufacturing. In this case, however, the problems recognized in Japanese Patent Laid-Open No. 63-197652 A, that is, the reduction in reliability, the instability of ejection performance, and the like due to a decrease in the attachment accuracy of the valve retaining member need to be solved appropriately, as a matter of course.

Here, it is necessary to secure attachment accuracy by fixing the valve supporting member to the substrate without having undesired warping or floating does with respect to the substrate. However, in a case where the valve supporting member and the substrate are caused to adhere to each other in processes of applying a liquid adhesive agent and then, curing the adhesive agent by heating, various problems to be described below occur.

Firstly, when the number of points where the adhesive agent is to be applied is small, the undesired warping or floating cannot be suppressed effectively. Moreover, since the adhesion strength between the substrate and the valve supporting member is weak in this case, there is a concern that the valve supporting member may be separated from the substrate due to the flow of ink.

In a case where the number of the application points and the amount of the adhesive agent to be applied are increased in order to solve these problems, the adhesive agent flows from the application point to the periphery thereof, and therefore the drops of the adhesive agent on the neighboring application points are connected to each other. This is because the adhesive agent is in a liquid state when being applied thereto. As a result of this, the valve retaining member and the substrate become in a state where they adhered to each other in a contiguous wide area (all over the surface in the extreme case) with the adhesive agent. In this case, a large amount of stress is generated on the adhesion interface by heating in the process of curing the adhesive agent, or by thermal influence occurring along with a printing operation. Specifically, the stress is generated in the adhesion portion due to curing and shrinkage of the adhesive agent, or a difference between the linear expansion coefficients of the adhesive agent and the substrate. This stress may generate a fine crack in the substrate. In general, the substrate is provided with a wiring of aluminum or the like for selectively driving the heater, so that an electrical short may occur when ink flows into the crack which has been generated. Moreover, an excessive amount of the adhesive agent applied thereto may inhibit ink from flowing in the printing head or the liquid path.

Furthermore, a metering discharge device (a dispenser) is used in general for the purpose of applying a predetermined amount of an adhesive agent to a desired position, but a shape of the applied adhesive agent cannot be accurately controlled by use of the metering discharge device. Accordingly, this produces a difference among the shapes of the drops of the adhesive agent after cured at the respective applied positions, and thereby generates a variation in the fixation state of the valve retaining member. Thus, it becomes extremely difficult to maintain a stable adhesion state, that is, the stable attachment accuracy.

In contrast to this, in the method disclosed in Japanese Patent Application Laid-open No. 10-16243 A, a structure in which, with application of a bonding technique, a valve supporting member is joined to the substrate with supporting members provided on a plurality of positions on the substrate. In such a structure, although problems related to the applying of the adhesive agent or the like do not occur, the positions and the number of joint points are not taken into consideration specifically. Moreover, a structure for effectively suppressing the undesired warping or floating is not suggested either.

SUMMARY OF THE INVENTION

The present invention has been made by taking the above-described problems into consideration. An object of the invention is to provide a liquid ejection head capable of performing a stable ejection operation at high speed even when thermal expansion of a valve supporting member occurs during liquid ejection. This is because the liquid ejection head allows the thermal expansion to influence supported valves only to a small extent, and a highly accurate and stable adhesion state to be obtained.

A liquid ejection head capable of ejecting a liquid by changing a position of a valve, which is integrally formed of a valve supporting member made of a plate, along with generation of an air-bubble caused by heating the liquid, and thus by leading growth of the air-bubble toward an ejection port from which the liquid is ejected, wherein the valve supporting member includes: first and second chipped portions which are positioned in an ejection direction of the liquid with a space interposed in between; a first area which is positioned between the first and second chipped portions, and which extends in a direction crossing the ejection direction; and a third chipped portion which is formed in an area including at least a part of the first area, and which extends over the entire area in the ejection direction in the first area.

In the liquid ejection head of the present invention, the chipped portions (holes or slits) are provided in the valve supporting member. This configuration prevents the influence of the thermal expansion from affecting the valves even though the valve supporting member is thermally expanded. Thus, according to the liquid ejection head of the present invention, it is possible to realize a liquid ejection head with which distortion of ejection, or a printing failure occurs less frequently.

Further features of the present invention will become apparent from the following description of exemplary embodiments (with reference to the attached drawings).

BRIEF DESCRIPTION OF THE DRAWINGS

FIG. 6A is a view showing a state where movable valves are attached to the valve seats, respectively. FIG. 6B is a view showing a state where a top plate is attached to the nozzle walls. FIG. 6C is a view showing a state of the element after the element is cut. FIG. 6D is a view showing a state of the element after the cut plane is grinded;

DESCRIPTION OF THE EMBODIMENTS

Hereinafter, the present invention will be described in detail with reference to the accompanying drawings.

Figure 1:
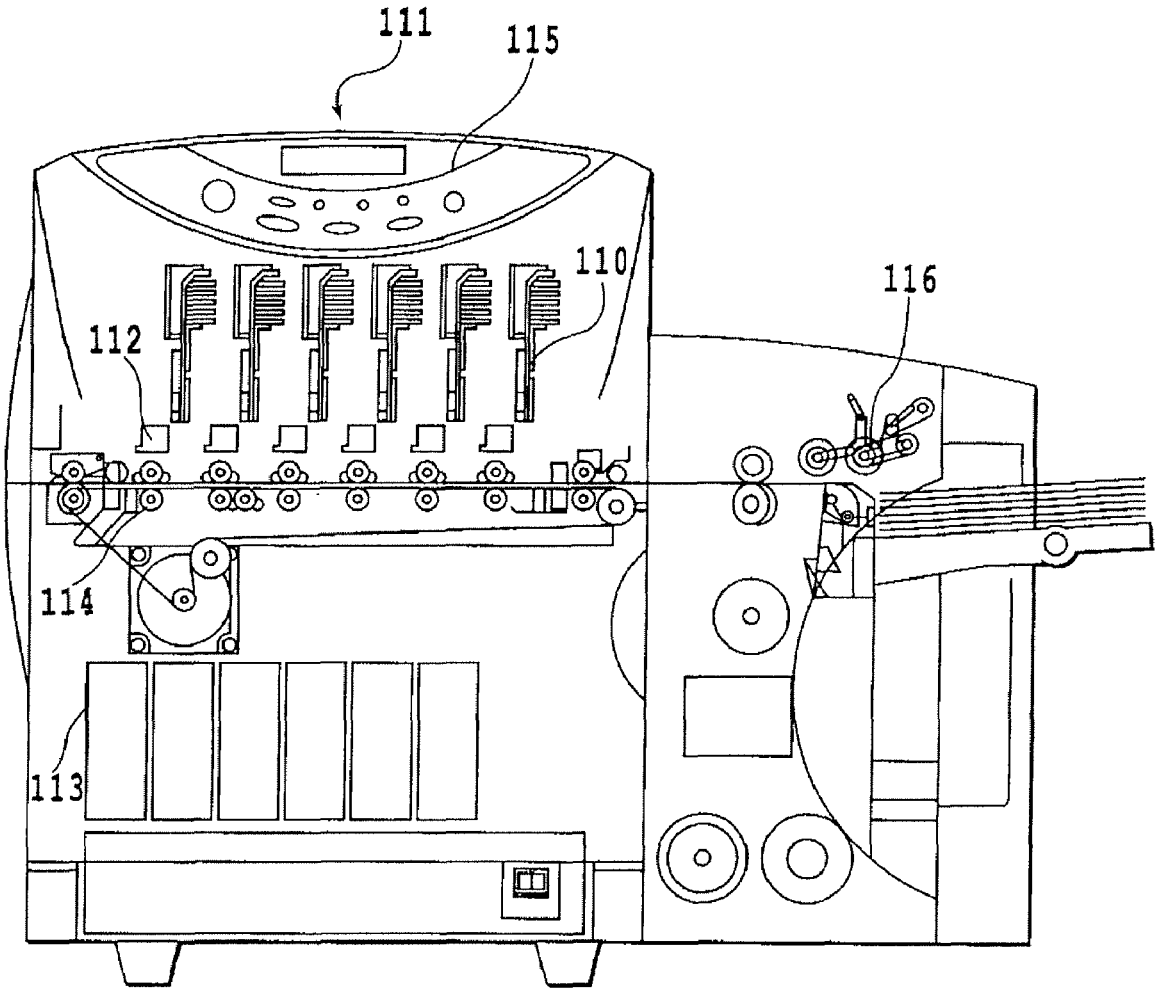
FIG. 1 is a front view of a liquid ejection apparatus provided with a liquid ejection head according to an embodiment of the present invention.

FIG. 1 is a front view showing an internal structure of a liquid ejection apparatus 111 provided with liquid ejection heads 110. The liquid ejection apparatus 111 in FIG. 1 is provided with a plurality of aforementioned liquid ejection heads 110. A printing medium supplied from a sheet supply unit 116 is delivered to a position facing the liquid ejection heads by a printing medium delivery unit 114. Then, liquids are respectively ejected from the liquid ejection heads, and thus printing is performed. A user can operate the liquid ejection apparatus 111 with an operation panel 115 located on a top front portion of the liquid ejection apparatus 111.

Figure 2:
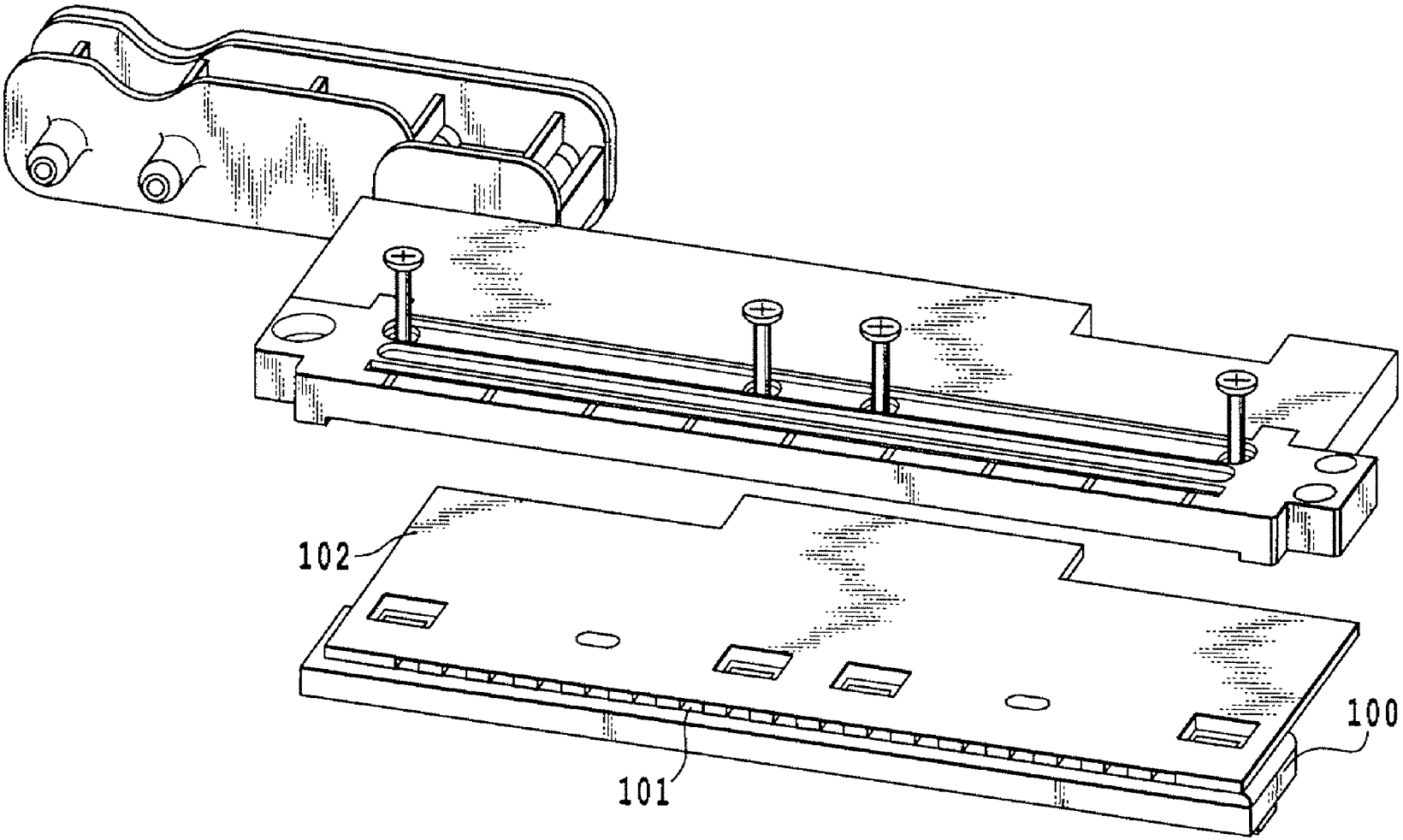
FIG. 2 is an exploded perspective view of a liquid ejection head according to an embodiment of the present invention.

FIG. 2 is an exploded perspective view showing a state where one of the liquid ejection heads is exploded.

A heater board 101 is supported by a base plate 100 made of ceramic. A wiring substrate 102 is arranged in a way that the base plate 100 is sandwiched between the wiring substrate 102 and the heater board 101. Then, a plurality of heaters 2 (refer to FIG. 4) on the heater board 101 and terminals on the wiring board 102 are connected to each other electrically by wire bonding.

Figure 3:
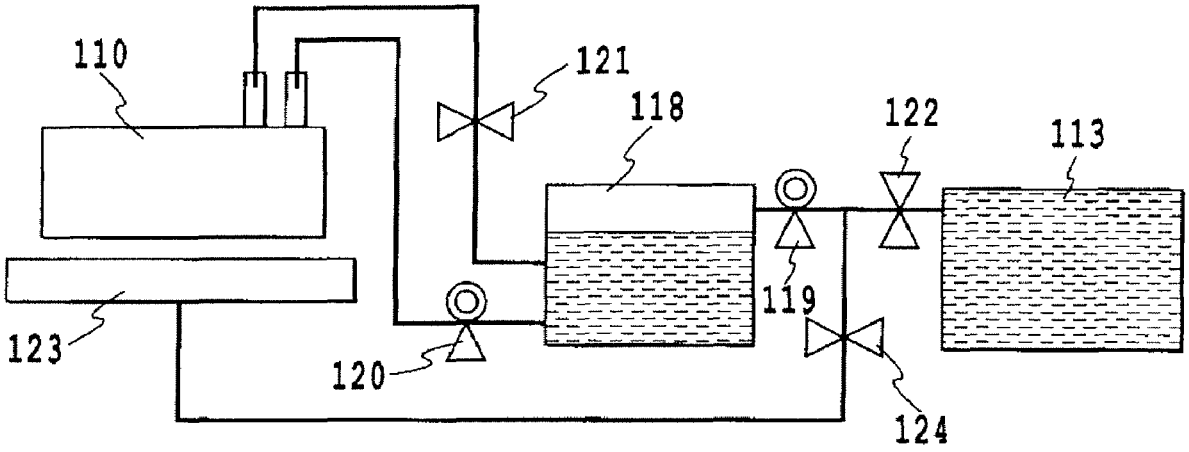
FIG. 3 is a diagram showing a configuration of a liquid supply system of the liquid ejection apparatus according to the embodiment of the present invention.

FIG. 3 is a diagram showing a configuration of a liquid supply system of the liquid ejection apparatus 111 according to the embodiment of the present invention. The liquid ejection apparatus 111 of the embodiment is provided with detachably-attachable cartridges 113 and sub tanks 118 each of which generates pressure to keep positions of meniscuses 19 (refer to FIG. 7) appropriately. Here, the meniscus 19 is a liquid surface formed on each of ejection ports 13 (refer to FIG. 4) of the liquid ejection head 110. Moreover, the liquid ejection apparatus 111 of the present embodiment is provided with supply pumps 119, pressurizing pumps 120, and recovery valves 121. The supply pump 119 supplies a liquid from the cartridge 113 to the subtank 118. The pressurizing pump 120 supplies a liquid from the subtank 118 to the liquid ejection head 110. The recovery valve 121 closes a return channel of a liquid from the liquid ejection head 110. The supply pumps 119 are used for a recycle operation which is to be described later, and are provided with supply valves 122, respectively, for selecting a channel at the time of the recycle operation. The recycle operation for recycling a liquid discharged from each of the liquid ejection heads 110 is performed by using recovery tubs 123 and recycle valves 124. The recovery tub 123 is provided below an ejection surface of the liquid ejection head 110. The recycle valve 124 is used for selecting a liquid channel of a liquid from the recovery tub 123 to the subtank 118.

Figure 4:
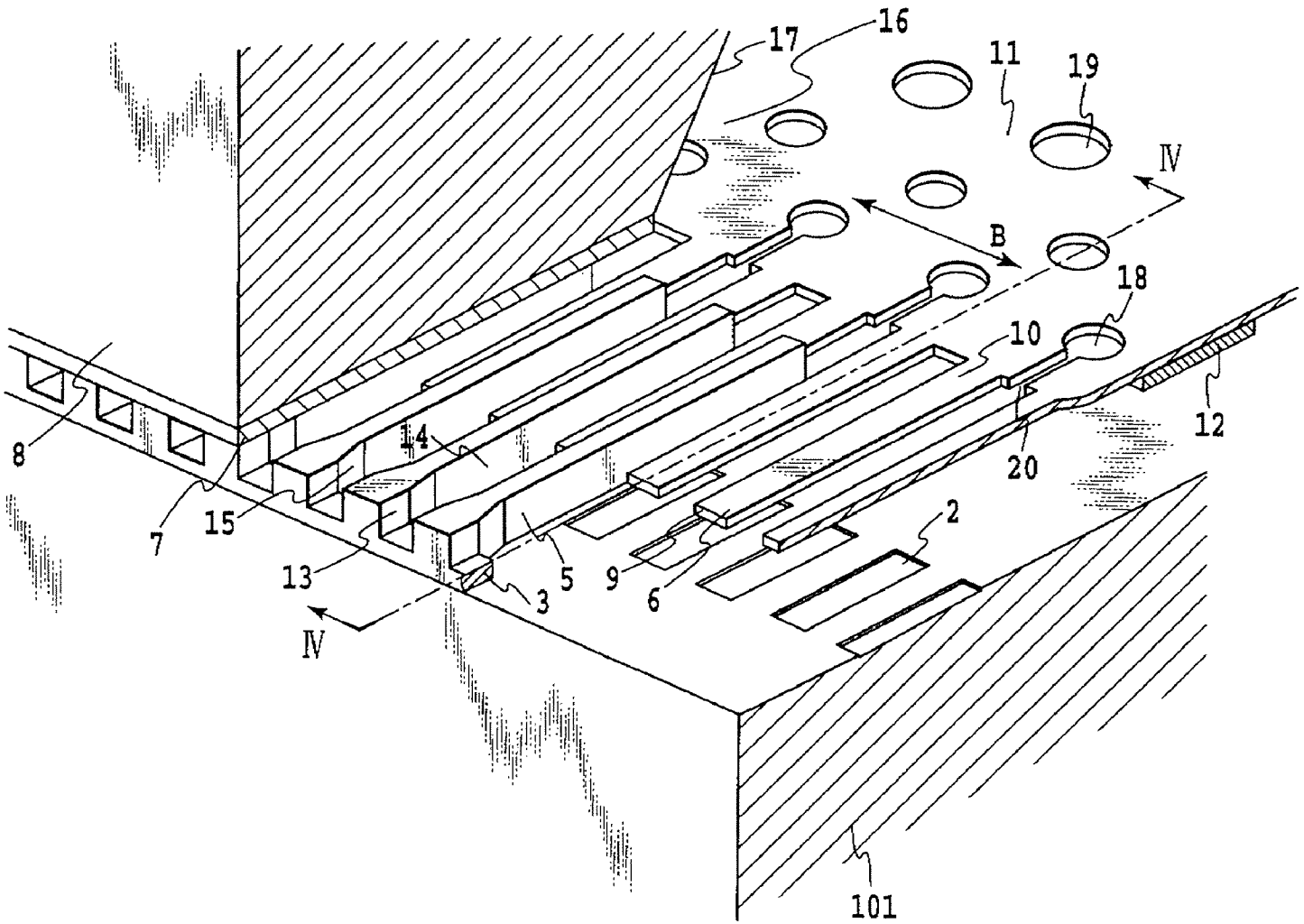
FIG. 4 is a cross sectional perspective view of the vicinity of nozzles of the liquid ejection head of the present embodiment.

FIG. 4 is a cross sectional perspective view of the vicinity of nozzles of the liquid ejection head of the present embodiment. The plurality of heaters 2 for generating bubbles of a liquid by heating are provided on the heater board 101. Each of the heaters 2 is formed of a resistor element of tantalum nitride or the like having a thickness from 0.01 μm to 0.5 μm, and a resistance from 10 O to 300 O per square. Moreover, electrodes (not shown) made of aluminum or the like for conducting electricity are connected to the heaters 2. Then, a switching transistor (not shown) for controlling the turning on/off of electricity for each of the heaters 2 is connected to each of the electrode. The switching transistor is controlled by an IC configured of a controller circuit of a gate element or the like, and is driven in a predetermined pattern in response to signals from a controller (not shown). The nozzles 14 are formed while corresponding to the plurality of heaters 2, respectively. Ejection ports 13 and a common liquid chamber 16 are in communication with each other through the nozzles 14. Moreover, each of the nozzles 14 has a tubular shape surrounded by the heater board 1 being provided with a bank 3 and a valve seat 12 on its surface; nozzle walls 5 on both sides; and a top plate nozzle 7 having a thickness of approximately 2 μm. Moreover, movable valves 6 are provided so as to extend in a comb-tooth shape from a valve supporting member 11, and to have free ends 9 facing in a direction towards the ejection ports 13.

Hereinafter, descriptions will be provided of a method of manufacturing the liquid ejection head of the present invention according to the embodiment with reference to FIGS. 5A to 5C and FIGS. 6A to 6D. It should be noted that FIGS. 5A to 5C and FIGS. 6A to 6D are cross sectional views each taken along the line IV-IV of FIG. 4, and each showing a state in which surfaces of ejection ports of two units of the liquid ejection head abut on each other. In the present embodiment, the liquid ejection head is manufactured by using the following method. Specifically, an ejection element is integrally formed as a single body in a manner that surfaces of ejection ports of two units of the liquid ejection head abut on each other, and then, the integrally formed ejection element is cut at a plane indicated by the dashed-dotted line shown in FIGS. 5A to 5C and FIGS. 6A to 6D in a process to be performed later. In this way, the ejection ports are formed. By use of such a method of manufacturing the liquid ejection head, the positional accuracy of the nozzles can be increased, and the liquid ejection head capable of printing with a higher quality image can be manufactured. Moreover, for the sake of simplifying descriptions, FIGS. 5A to 5C and FIGS. 6A to 6D schematically show manufacturing processes of the liquid ejection head by changing a dimensional relationship of the liquid ejection head from that of the liquid ejection head shown in FIG. 4.

Figure 5A:
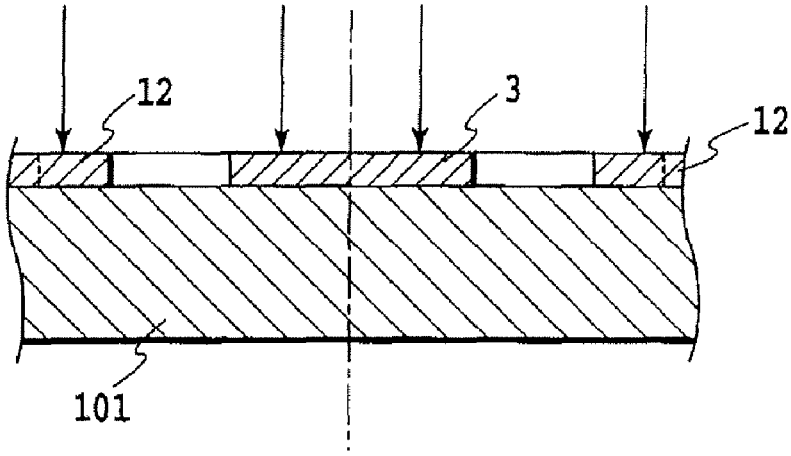
FIG. 5A is a view showing a state where a bank and valve seats are formed on a base plate.
Figure 5B:
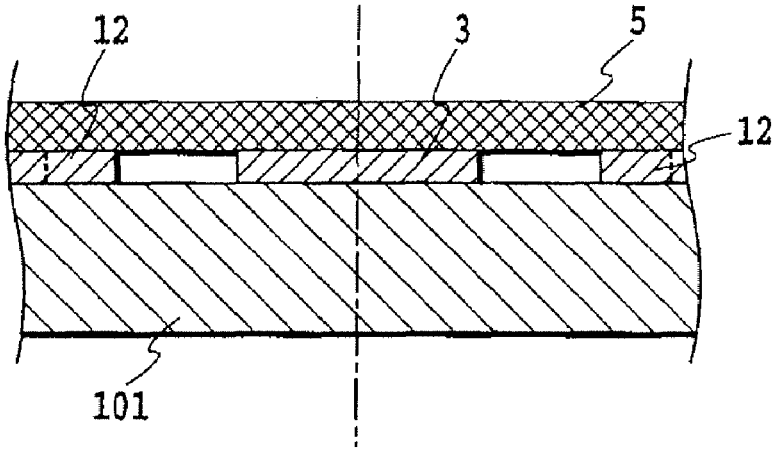
FIG. 5B is a view showing a state where an ultraviolet-ray photosensitive resin film is laminated on the bank and valve seats for forming nozzle walls.
Figure 5C:
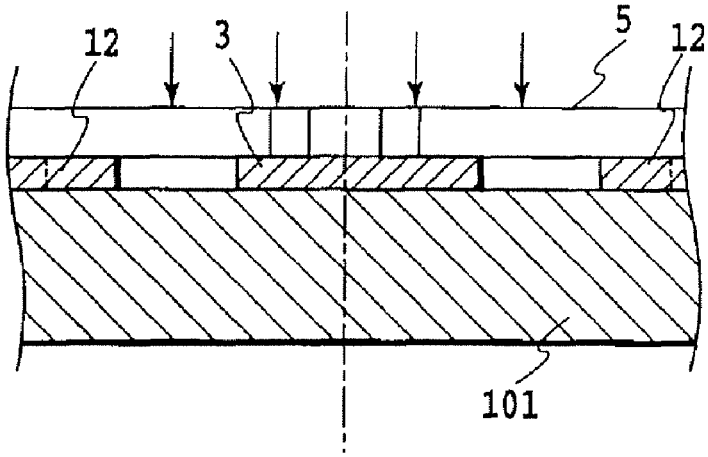
FIG. 5C is a view showing a state where the nozzle walls are formed by irradiating the ultraviolet-ray photosensitive film with ultraviolet rays.

FIG. 5A is a view showing a state where the bank 3 and the valve seats 12 are formed on the base plate 101. Firstly, by use of the same manufacturing equipment as one used in a manufacturing process of semiconductor devices, the heaters 2 made of hafnium boride, tantalum nitride or the like are formed on the base plate 101 made of a silicon wafer. Thereafter, the front surface of the base plate 101 is cleaned, and then, surface modification is further performed on the front surface of the base plate 101 by using ultraviolet-ozone or the like for the purpose of improving adhesion. Next, an ultraviolet-ray photosensitive resin film is laminated on the base plate 101. After that, portions of the ultraviolet-ray photosensitive resin film to be left as the nozzle banks 3 and the valve seats 12 to which the movable valves 6 adhere are irradiated with ultraviolet rays by using a photomask. FIG. 5B is a view showing a state where another ultraviolet-ray photosensitive resin film for making nozzle walls 5 is laminated on the nozzle bank 3 and the valve seats 12. FIG. 5C is a view showing a state where the nozzle walls 5 are formed by irradiating the ultraviolet-ray photosensitive resin film laminated thereon in FIG. 5B with ultraviolet rays. After being irradiated with ultraviolet rays, the ultraviolet-ray photosensitive resin film is developed with a mixture of xylene and butylcellosolve acetate. Then, by causing unexposed portions of the ultraviolet-ray photosensitive resin film to melt, the exposed and cured portions are formed as the nozzle walls 5.

FIGS. 6A to 6D are views showing the process subsequent to and after the process shown in FIGS. 5A to 5C. FIG. 6A is a view showing a state where the movable valves 6 are attached to the valve seats 12, respectively. The movable valves 6 are respectively fixed to the valve seats 12 with an adhesive agent in a manner the movable valves 6 is cantilevered with their front ends facing in a direction towards ejection ports side. FIG. 6B is a view showing a state where a top plate 8 is attached to the nozzle walls 5. The top plate 8 is previously laminated with a top plate nozzle 7 formed of a photosensitive resin film, and then the top plate 8 is adhered to the nozzle walls 5. Thereafter, the ejection element is cut at a plane indicated by the dashed-dotted line shown in FIGS. 6A to 6B, and then, an ejection portion as shown in FIG. 6C is formed. FIG. 6D shows a state of the ejection portion after the cut plane is subjected to a grinding process. When the cut plane is grinded, since elasticity of a portion formed of the resin material is high, the portion protrudes therefrom as shown in FIG. 6D. Accordingly, since the portion formed of the resin material protrudes therefrom, the resin material portion can serve this role without attaching an orifice plate conventionally used for an ejection portion.

Next, a method of manufacturing the movable valves 6 and the valve supporting member 11 will be explained. An ultraviolet-ray photosensitive resin film is laminated on a substrate wafer serving as a base member. Then, a desired pattern is formed on the wafer through exposure of ultraviolet rays. By use of this, Ni is grown on the wafer by electroforming so as to have a thickness of approximately 5 μm. Thereafter, by causing the pattern to melt, the movable valves 6 and valve supporting member 11 are integrally formed as a single body on the wafer. The integrally formed body is removed from the wafer, and then, the manufacturing of the movable valves 6 and the valve supporting member 11 is completed.

Figure 7:
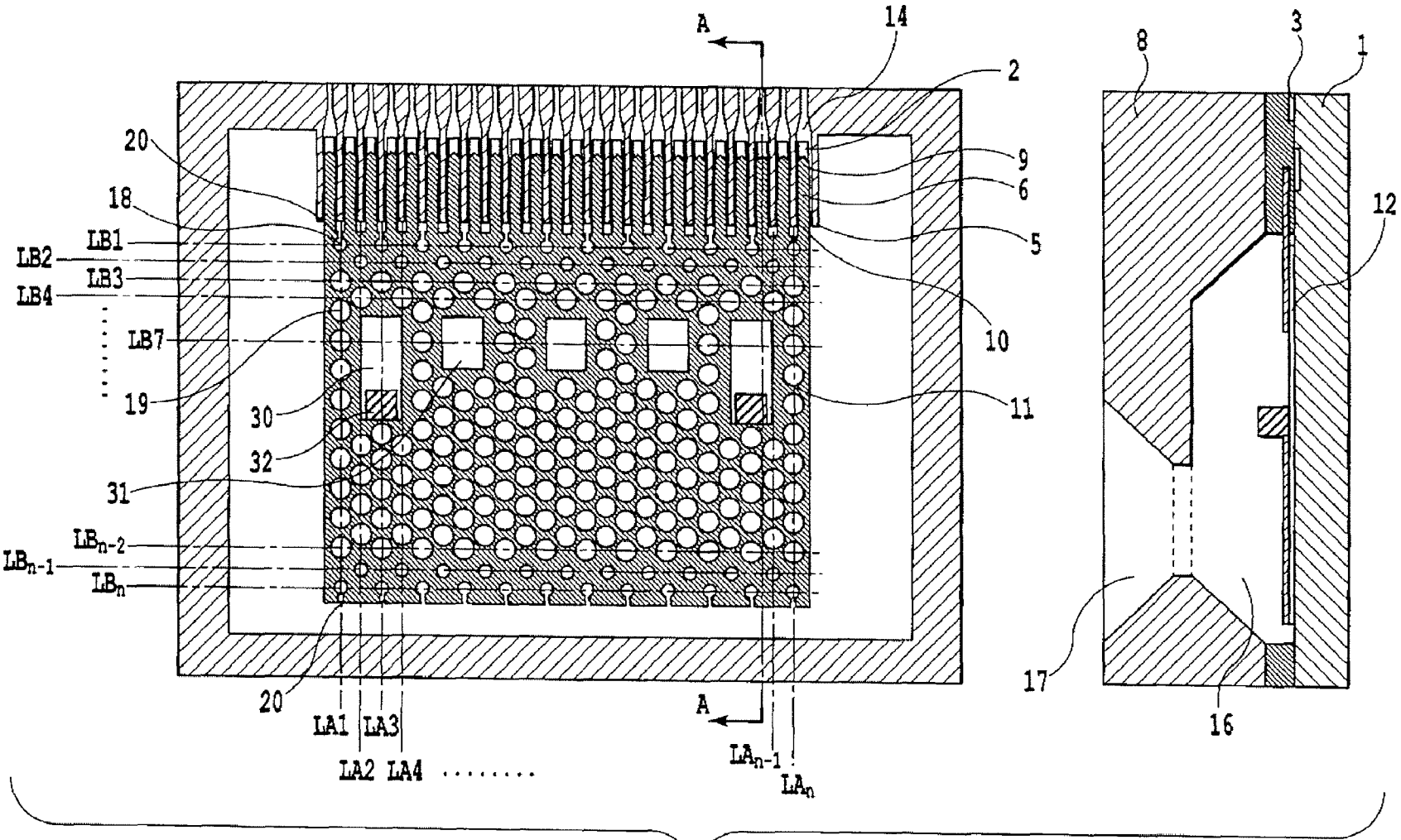
FIG. 7 is a transverse cross sectional view of the vicinity of the nozzles of the liquid ejection head of the present embodiment.

FIG. 7 is a transverse cross sectional view of the vicinity of the nozzles of the liquid ejection head of the present embodiment. The valve supporting member 11 manufactured in the method described above is provided with a plurality of first holes 19 and second holes 18 in order to suppress, as much as possible, a change in dimensions of the valve supporting member 11, which may occur due to thermal expansion of the valve supporting member 11. The provision of these holes results from a consideration of adverse thermal influence caused during a heating process for curing an adhesive agent for attaching the valve supporting member 11 to the valve seats 12, or during a recoding operation. The first holes 19 have their centers respectively on lines LB3 to LBn-2, which are parallel with an arrangement direction of the movable valves 6 on the valve supporting member 11; and on lines LA1 to LAn, which are parallel with a direction perpendicular to the arrangement direction of the movable valves 6. Thus, the first holes 19 are arranged in a staggered manner. The second holes 18 have their centers respectively on lines LB1, LB2, LBn-1 and LBn-2, which are parallel with the arrangement direction of the movable valves 6 on the valve supporting member 11, and on lines LA1 to LAn which are parallel with a direction perpendicular to the arrangement direction of the movable valves 6. Thus, the second holes 18 are arranged in a staggered manner. In other words, the second holes 18 are arranged in the staggered manner at left and right ends outside a group of the first holes 19 in the direction parallel with the arrangement direction of the movable valves 6. In addition, each of the second holes 18 is formed with a diameter smaller than that of each of the first holes 19. Thus, a larger portion made of a material in the valve supporting member 11 is left at the left and right ends. By leaving the larger portion made of the material in the valve supporting member 11, the strength of the valve supporting member 11 itself is enhanced. Thus, the valve supporting member 11 is prevented from being broken when separated from the wafer during the manufacturing. Furthermore, slits 20, which are chipped portions, are respectively provided to the second holes 18 arranged on the lines LB1 and LBn. Then, each of the second holes 18 on the line LB1 are provided with a slit 20 so as to communicate with a space between the closest two movable valves 6 to the second hole 18. In addition, each of the second holes 18 on the line LBn is provided with a slit 20 so as to form an opening at the end portion of the valve supporting member 11, the end portion being the closest to the second hole 18.

The arrangement of chipped portions of the second holes 18, the first holes 19 and the slits 20 is provided particularly in consideration of the prevention of expansion of the valve supporting member 11 in the arrangement direction of the movable valves 6 (the direction indicated by an arrow B in FIG. 6). Specifically, in a case where a cutting plane of the valve supporting member 11 which is obtained by cutting at every line parallel with the line LB1 is viewed as a cross section, any cross section in any portion is not a single continuous cross section. This is because these second holes 18, the first holes 19 and the slits 20 are provided therein. Accordingly, even when the valve supporting member is thermally expanded, the thermal influence on operations of the movable valves 6 during liquid ejection can be suppressed as much as possible by providing the second holes 18, the first holes 19 and the slits 20 in the above described manner. Moreover, the dispersed arrangement of plural pieces of the second holes 18 and the first holes 19 allows the diameter of each of the holes to be reduced, and thereby, prevents the strength of the valve supporting member 11 to be extremely deteriorated. Moreover, this configuration allows the valve supporting member 11 to absorb vibrations more easily, and thereby the valve supporting member 11 to absorb vibrations of the movable valves 6 during the liquid ejection. Thus, the vibrations of one of the movable valves 6 do not influence an operation of the different movable valves 6 adjacent to the concerned movable valve 6.

Two types of quadrangle holes are further provided in the valve supporting member 11. One type of the quadrangle holes is used for positioning the valve supporting member 11 on the valve seats 12, and the other type of the quadrangles is used for attaching and fixing the valve supporting member 11 on the valve seats 12. Each of the quadrangle holes 30 for positioning is a rectangle hole having the centerline on a corresponding one of the line LA 3 and LAn-2, and having its longitudinal direction in a direction of the centerline. When regarding a portion of the valve supporting member 11 including the movable valves 6 as a front of the valve supporting member 11, the quadrangle holes 30 are provided so as to position the valve supporting member 11 at rear ends of the quadrangle holes 30 by supporting columns 32 made of the same material as that of the nozzle walls 5. In addition, as the quadrangle holes 31 for attaching and fixing, three quadrangles having their centerlines on the line LB7 are aligned between the two quadrangle holes 30.

Incidentally, the term, a "chipped portion" used in this specification means both of slits including a hole in a closed space and an open space as the one described above.

Figure 8:
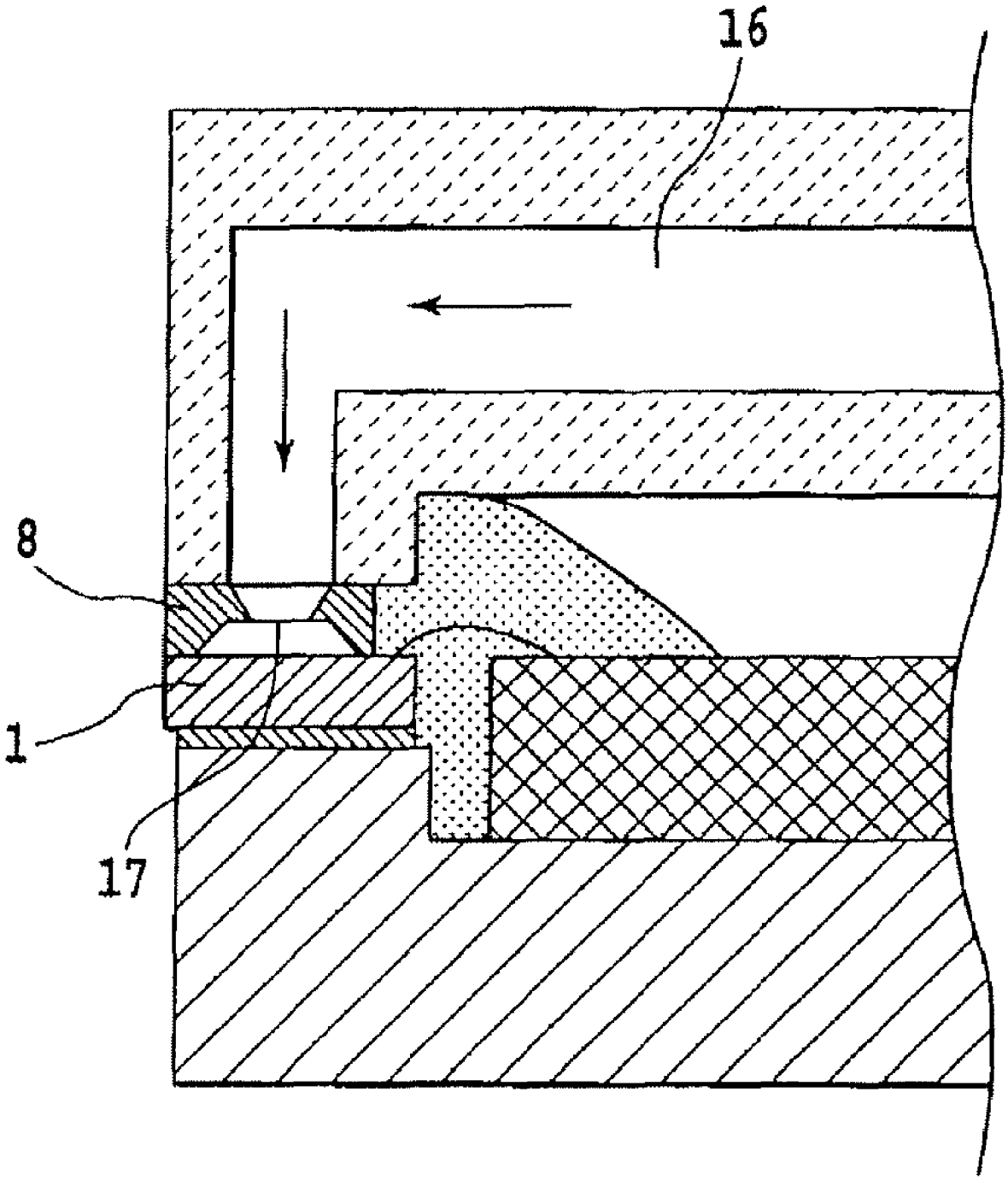
FIG. 8 is a cross sectional view showing a structure of the periphery of an ejection port of the liquid ejection head of the present embodiment.

FIG. 8 is a cross sectional view showing a structure of the periphery of one of the ejection ports 13 of the liquid ejection head of the present embodiment. A liquid is supplied to a supply orifice after passing through the common liquid chamber 16 as shown by arrows in FIG. 8.

Figure 9A:
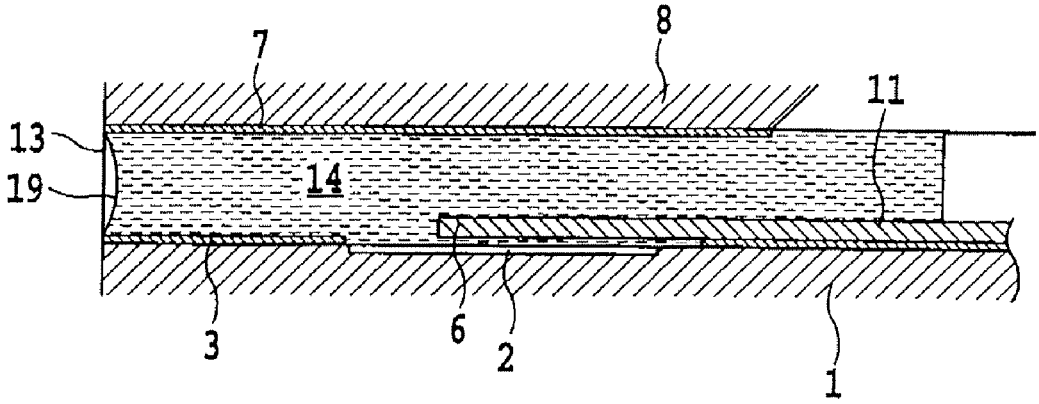
FIG. 9A is a view showing a state of the element before electric energy is applied to a heater.
Figure 9B:
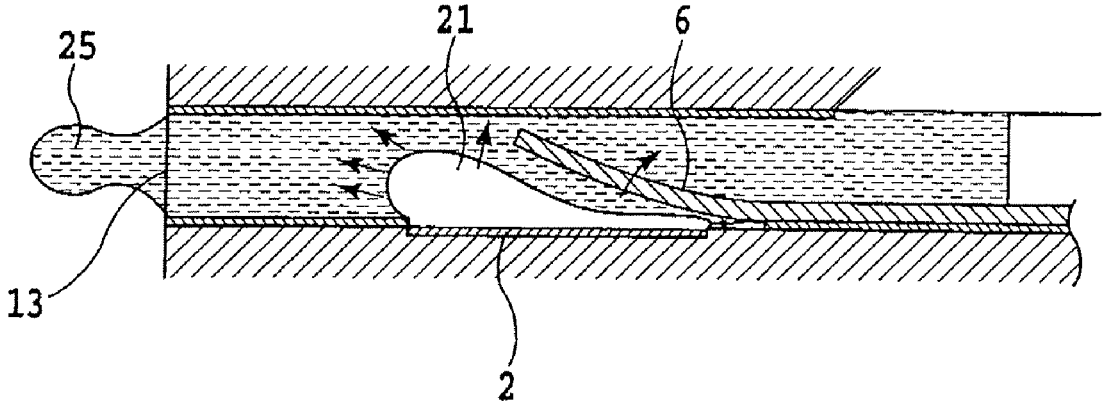
FIG. 9B is a view showing a state where an air-bubble is generated in the liquid.
Figure 9C:
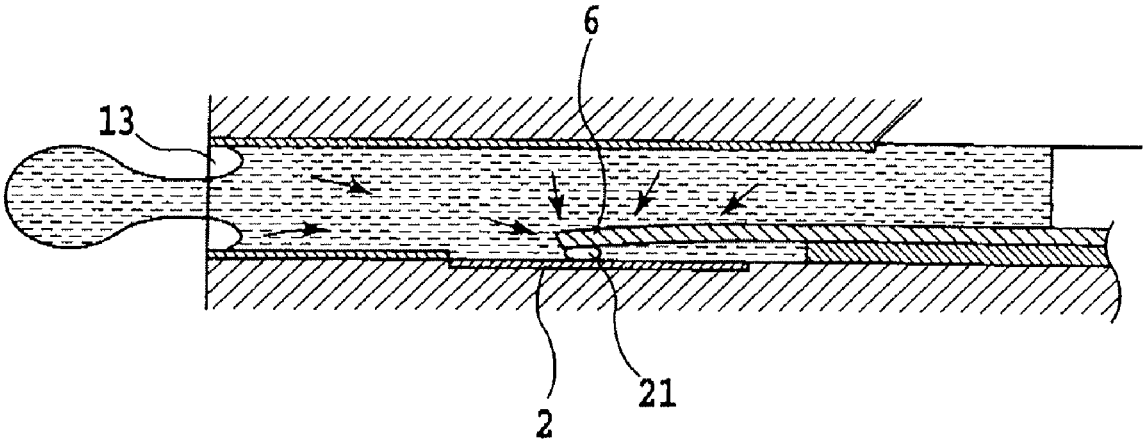
FIG. 9C is a view showing a moment when the liquid is just ejected from the ejection port.

With reference to FIGS. 9A to 9C, descriptions will be provided of a process of ejecting a liquid in the liquid ejection head including the movable valves 6 in the nozzles 14. FIG. 9A is a view showing a state of one of the nozzles 14 before electric energy is applied to the heater 2. Since an air-bubble 21 (refer to FIG. 9B) is not yet generated, the movable valve 6 is kept in equilibrium. Then, FIG. 9B shows a state where the heater 2 generates heat when electric energy is applied thereto, and where then the air-bubble 21 is generated in the liquid. When the air-bubble 21 is generated, by pressure caused by the generation of the air-bubble 21, the movable valve 6 changes its position so as to cause the direction of growth of the air-bubble 21 to be the direction toward the ejection port 13. Then, as the air-bubble 21 grows, the liquid in the nozzle 14 moves in the direction toward the ejection port 13, and thus, an ejected liquid column 25 is formed. FIG. 9C is a view showing a moment when the liquid is just ejected from the ejection port 13. When the liquid is ejected from the nozzle 14 as shown in FIG. 9C, the air-bubble 21 shrinks as the pressure inside the air-bubble 21 becomes negative pressure. Then, the movable valve 6 changes its position so as to return to the state shown in FIG. 9A, which is equilibrium, from the state shown in FIG. 9C.

Normally, at the time of printing, the operations shown from FIGS. 9A to 9C are repeated. These operations need to be smoothly performed even during high-speed printing. Here, a valve changes its position by pressure caused by the generation of an air-bubble at the time of printing, and the valve needs to recover to an equilibrium state immediately after a desired amount of ink is ejected. Since the valve supporting member 11 in the case of the present embodiment includes the plurality of holes, vibrational components of each of the movable valves 6 are dispersed. As a result, even though there is slight transmission of vibrations, the vibrations can be suppressed to a large extent in comparison with an element having no holes. Thus, the movable valves 6 can recover to the equilibrium state immediately.

Figure 10:
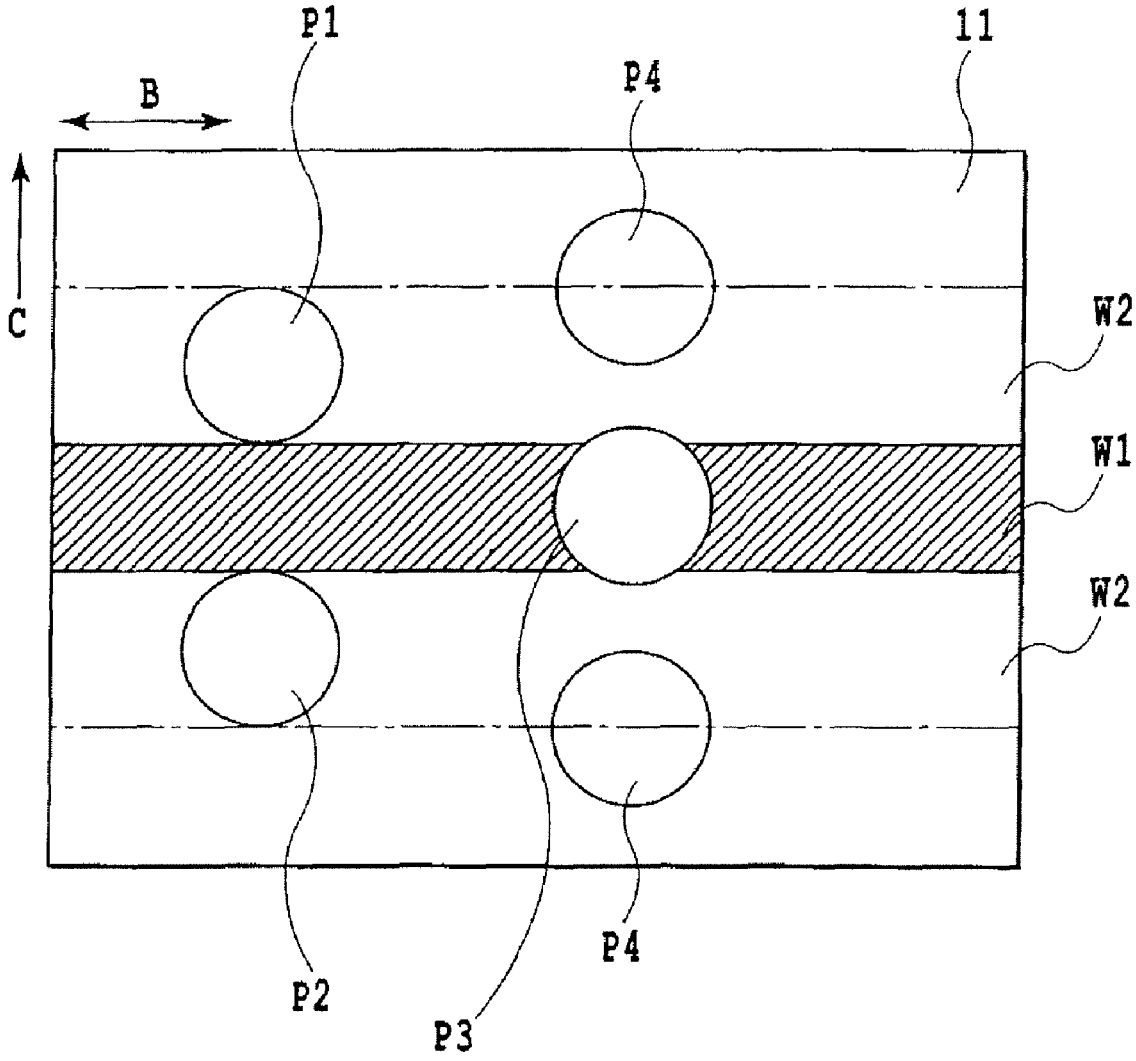
FIG. 10 is a plane view schematically showing a valve supporting member and chipped portions provided therein in the embodiment of the present invention.

Here, with reference to FIG. 10, descriptions will be further given of the chipped portions provided in the valve supporting member in the liquid ejection head of the present invention.

FIG. 10 is a plane view schematically showing the valve supporting member 11, and the chipped portions provided thereon in the embodiment of the present invention. As shown in FIG. 10, the valve supporting member 11 includes a chipped portion P1 (a first chipped portion), a chipped portion P2 (a second chipped portion) which are provided with a predetermined distance interposed in between. The valve supporting member 11 includes an area W1 (a first area). The area W1 is an area of the valve supporting member 11 which is positioned between the chipped portions P1 and P2, and which extends in a direction (the direction indicated by an arrow B in FIG. 10) crossing an ejection direction (the direction indicated by an arrow C in FIG. 10). Moreover, the valve supporting member 11 includes a chipped portion P3 (a third chipped portion) and areas W2. The chipped portion P3 extends over an entire area in the direction indicated by the arrow C in the area W1. The chipped portions P1 and P2 are located in the areas W2, respectively, and the areas W2 extend in the direction indicated by the arrow B. In addition, the valve supporting member 11 further includes chipped portions P4 which include parts of the areas W2 (the second areas), respectively.

By employing a configuration in which the chipped portions are provided in the valve supporting member 11 as described above, an liquid ejection had can be achieved which makes it possible to suppress the expansion of the valve supporting member 11 as much as possible, and thus, to reduce irregularities of ejection, and occurrences of a printing failure.

It should be noted that, in the present embodiment, although the slits 20 are provided to the second holes 18 on the line LBn so as to form an opening at the end portion of the valve supporting members 11 closest to the second hole 18. However, it is confirmed that the thermal expansion of the movable valves 6 does not affect a liquid ejection without providing the slits 20, since the slits 20 provided respectively in the second holes 18 on the LBn are far from the movable valves 6.

Moreover, in this embodiment, employed is the configuration in which the plurality of holes each having a circular shape are arranged in a staggered manner, and in which the slits 20 are provided thereto for the purpose of suppressing the thermal expansion of the valve supporting member 11. The shape of a hole, however, is not limited to a circular shape, and other shapes, for example, a polygonal including a quadrangle, a triangle or the like may be employed.

In addition, although the first holes 19 and the second holes 18 are provided in a staggered manner in this embodiment, it is not limited to the staggered manner. The first holes 19 and the second holes 18 may be arranged in any manner so long as the operations of the movable valves 6 during liquid ejection are not affected by the thermal expansion of the valve supporting member 11. For example, circular holes may be arranged in a curved line.

Moreover, although the plurality of first holes 19 and second holes 18 are provided in the valve supporting member 11 in this embodiment, it is not limited to this, and a single continuous hole may be provided.

Furthermore, although the slit 20 is provided to the second hole 18 corresponding to every second space between the movable valves 6 in this embodiment, the providing manner is not limited to this. The slit 20 may be provided at each supporting point 10.

Moreover, although the two quadrangle holes 30 for positioning are provided in this embodiment, it is not limited to this. At least one quadrangle hole 30 may be provided. However, in a case where only one quadrangle hole 30 is provided, the displacement of the valve supporting member 11 in a rotation direction easily occurs when the valve supporting member 11 is positioned.

Still furthermore, although the three quadrangle holes 31 for attaching and fixing are provided in this embodiment, it is not limited to this. The number of quadrangle holes 31 can be any number not less than one, as long as the valve supporting member 11 can be attached and fixed to the valve seats 12.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-058413, filed Mar. 3, 2006, which is hereby incorporated by reference herein in its entirety.

What is claimed is:

1. A liquid ejection head capable of ejecting a liquid by changing a position of a valve, which is integrally formed of a valve supporting member made of a plate, along with generation of an air-bubble caused by heating the liquid, and thus by leading growth of the air-bubble toward an ejection port from which the liquid is ejected, wherein the valve supporting member includes:

first and second chipped portions which are positioned in an ejection direction of the liquid with a space interposed in between;

a first area which is positioned between the first and second chipped portions, and which extends in a direction crossing the ejection direction; and a third chipped portion which is formed in an area including at least a part of the first area, and which extends over the entire area in the ejection direction in the first area.

2. The liquid ejection head according to claim 1, wherein the valve supporting member includes a plurality of aforementioned third chipped portions.

3. The liquid ejection head according to claim 1, wherein the valve supporting member includes a plurality of sets of the first, second and third chipped portions, and the first area in combination.

4. The liquid ejection head according to claim 1, wherein the valve supporting member includes:

a second area in which at least one of the first and second chipped portions is positioned, and which extends in the direction crossing the ejection direction; and a fourth chipped portion formed in an area including at least a part of the second area.

5. The liquid ejection head according to claim 1, wherein at least one of the plurality of chipped portions forms a closed space in the valve supporting member.

6. The liquid ejection head according to claim 1, wherein at least one of the plurality of chipped portions forms an open space in a marginal area of the valve supporting member.

7. The liquid ejection head according to claim 1, wherein the plurality of chipped portions are arranged in a staggered manner.

8. The liquid ejection head according to claim 1, wherein the plurality of chipped portions have at least two different sizes.

9. The liquid ejection head according to claim 1, wherein the valve supporting member includes a plurality of marginal portions in a linear shape, and a size of one of the chipped portions positioned at least one of the plurality of marginal portions is smaller than that of the chipped portion positioned at a central portion of the valve supporting member.

* * * * *